United States Patent [19]

Bayer

[11] Patent Number: 4,967,913

[45] Date of Patent: Nov. 6, 1990

[54] FOLDABLE FOOTWEAR SUPPORT DEVICE

[76] Inventor: Earl F. Bayer, 23 Dahlia Rd., Somerset, N.J. 08873

[21] Appl. No.: 174,860

[22] Filed: Mar. 29, 1988

[51] Int. Cl.[5] ..... A47F 7/00

[52] U.S. Cl. ..... 211/38; 211/118; 211/133

[58] Field of Search ..... 211/38, 34, 118, 72, 211/133; 206/292, 299, 278

[56] References Cited

U.S. PATENT DOCUMENTS

| | | | |
|---|---|---|---|
| 395,190 | 12/1888 | Stevens et al. | 206/278 |
| 908,392 | 12/1908 | Casteel . | |
| 926,041 | 6/1909 | Woodbury | 206/292 |
| 1,670,973 | 5/1928 | May . | |
| 1,909,942 | 5/1933 | Fingerman . | |
| 1,974,156 | 9/1934 | Hockmeyer | 206/278 X |
| 2,389,910 | 11/1945 | Hoffman . | |
| 2,533,725 | 12/1950 | Eisenberg | 206/292 X |
| 2,581,099 | 1/1952 | Guffey | 206/278 X |
| 3,635,353 | 1/1972 | Matsubara . | |
| 3,749,232 | 7/1973 | Craig | 206/278 |

*Primary Examiner*—Alvin C. Chin-Shue

*Assistant Examiner*—Sarah A. Lechok

*Attorney, Agent, or Firm*—Watson, Cole, Grindle & Watson

[57] ABSTRACT

A foldable footwear support device for displaying and/or storing footwear articles comprises two rectangular panel sections having a hinge joint therebetween and an upwardly open pouch attached to each of the panel sections, the pouches being capable of containing the toe portions of footwear articles such as slippers and the panel sections being pivotable relative to one another. When pivoted into a coplanar orientation and when the two panel sections have holes in their upper corners, the device can be hung from wall brackets to display the footwear articles. When the two panel sections are pivoted about the hinge joint to be partially folded together, the device can be positioned on a flat surface to display the footwear articles. When the two panel sections are pivoted to contact one another on their sides opposite the pouches, the device can be inserted in a packaging container, the device supporting the footwear articles therein in proper position for display when the packaging container has one or more transparent windows.

7 Claims, 2 Drawing Sheets

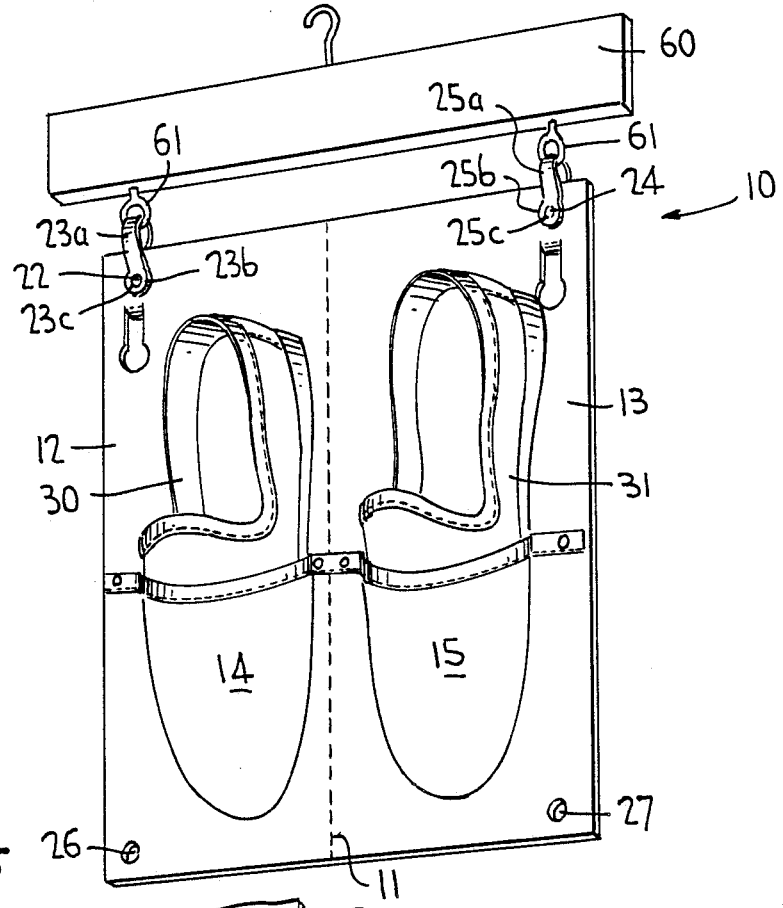
FIG. 4
FIG. 5
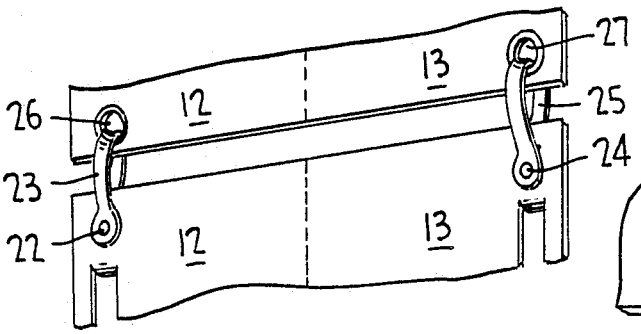
FIG. 6
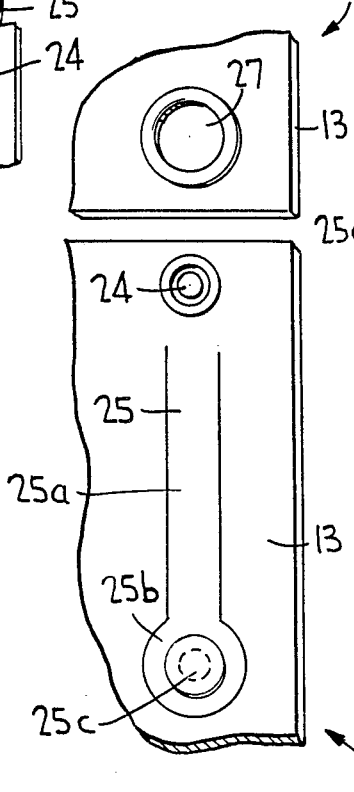
FIG. 7
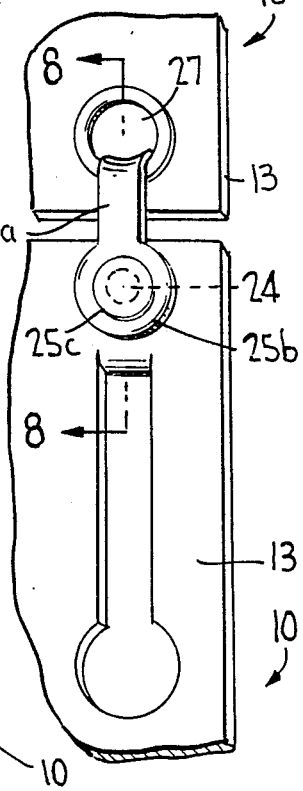
FIG. 8
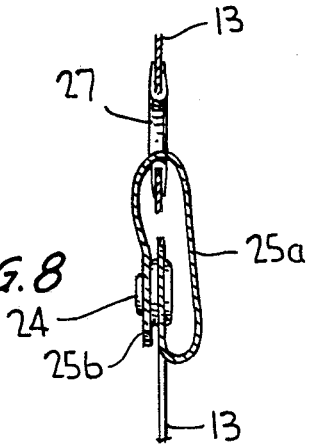

FOLDABLE FOOTWEAR SUPPORT DEVICE

BACKGROUND OF THE INVENTION

1. Field of the Invention

The present invention relates to devices which can be used to support footwear articles such as shoes and slippers.

2. The Prior Art

Support devices for displaying footwear articles are well known (see, for example, U.S. Pat. Nos. 908,392 and 1,670,973), and support devices for storing footwear articles are also well known (see, for example, U.S. Pat. Nos. 1,909,942, 2,389,910 and 3,635,353). However, no known support devices can be used to support a pair of footwear articles in a packaging container and also to support the pair of footwear articles outside the packaging container for display and/or storage purposes.

It is thus an object of the present invention to provide a multipurpose footwear support device which can be used (a) to support the footwear articles in a packaging container in such a way that they can be viewed through one or more transparent windows in the sides of the packaging container, (2) to support the footwear articles on a flat surface or against a wall for display, and/or (3) to support the footwear articles from a hanger, e.g., for storage.

SUMMARY OF THE INVENTION

The footwear support device of the present invention comprises two rectangular panel sections which have front and rear surfaces, upwardly-open pouches respectively attached to their front surfaces, and a hinge means connecting the panel sections together. The pouches function to support the toe portions of a pair of footwear articles therein, whereas the hinge means allows the two panel sections to be pivoted so as to be either coplanar, in a partially folded condition or in a fully folded condition. When the panel sections are in a coplanar condition and when they include holes in their upper corners, the footwear support device can be suspended from wall brackets or from an accessory hanger, e.g., for respectively displaying the footwear articles or for storing the footwear articles in a closet. When in a partially folded condition, they can be placed on a flat surface for displaying the footwear articles thereon. And when in a fully folded condition, they can be inserted in a packaging container so that the footwear articles thereon will be securely positioned in the packaging container and, if the packaging container has one or more transparent windows in its side, viewable through the windows. The left and right panel sections can also include attachment nipples and integral hang tabs in their upper corners to enable the footwear support device as a whole to be suspended from eye hooks or from other footwear support devices whose left and right panel sections have holes in their lower corners. The inventive footwear support device can be made out of plastic or cardboard and thus will be lightweight and inexpensive to manufacture.

The invention will be better understood by reference to the attached drawings, taken in conjunction with the following discussion.

BRIEF DESCRIPTION OF THE DRAWINGS

In the drawings,

FIG. 4 is a perspective front view of a second variation of the footwear support device shown in FIGS. 1 and 2, the device being shown in an unfolded condition and hanging from an accessory hanger, FIG. 5 is a partial perspective front view of the footwear support device as shown in FIG. 4, the device being shown hanging from the bottom of a similar footwear support device, FIGS. and 7 show enlarged details of the two footwear support devices shown in FIG. 5, both before and after attachment, respectively, and FIG. 8 is a view of FIG. 7 as seen along line 8—8 therein.

DETAILED DESCRIPTION OF THE PREFERRED EMBODIMENTS

Figure 3:
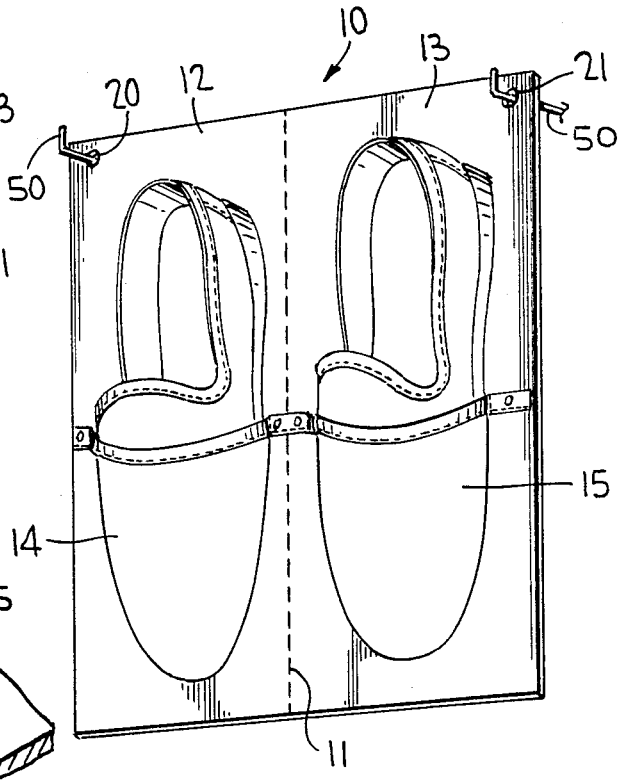
FIG. 3 is a perspective front view of a first variation of the footwear support device shown in FIGS. 1 and 2, the device being shown in an unfolded condition and suspended from two spaced apart wall brackets.

In the following discussion the terms front, rear, upper, lower, left and right will be used on the assumption that the inventive footwear support device is vertically oriented relative to the viewer as shown in FIG. 3.

Figure 1:
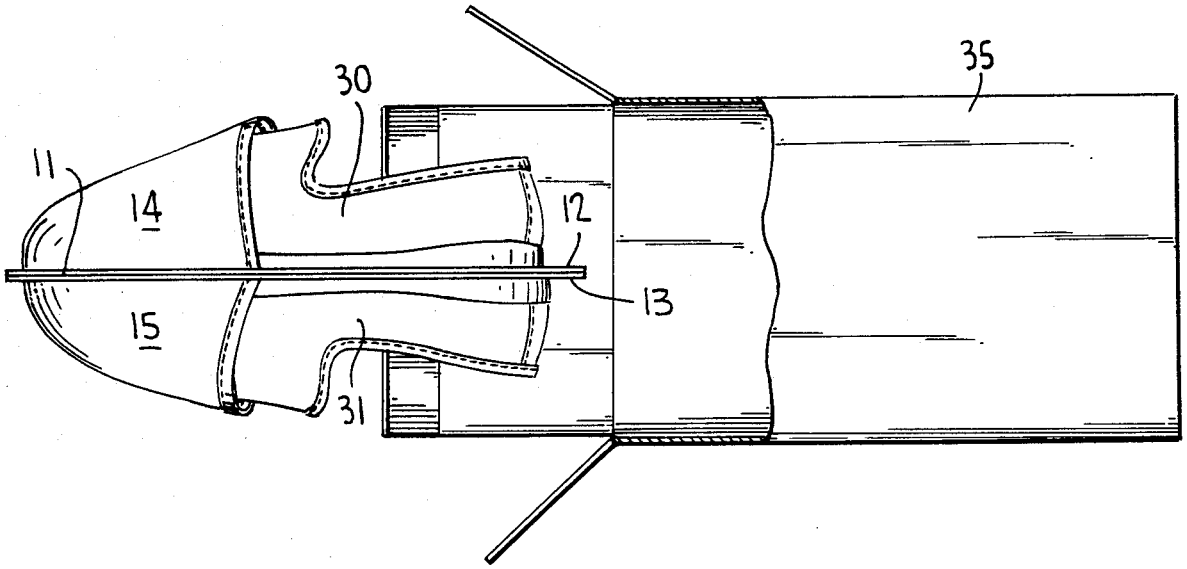
FIG. 1 is a side view of a preferred embodiment of a footwear support device according to the present invention, the device being shown in a completely folded condition and oriented for insertion in a packaging container, two slippers being also shown mounted on the device.
Figure 2:
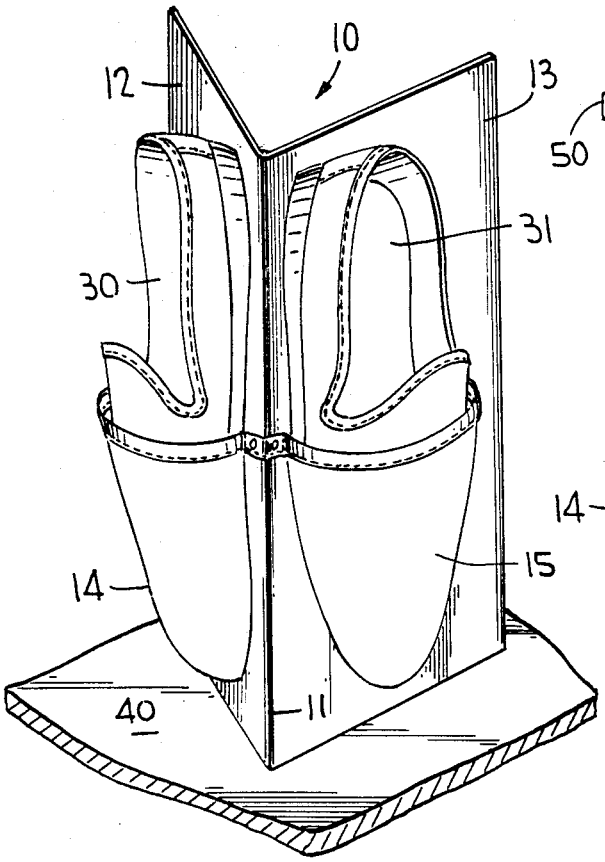
FIG. 2 is a perspective front view of the footwear support device and mounted slippers as shown in FIG. 1, the device being shown in a partially folded condition and standing on a flat surface.

A preferred embodiment of a footwear support device according to the present invention is shown in FIGS. 1 and 2. As best seen in FIG. 2, it comprises a rectangular panel 10 which is made of any suitable material which is reasonably rigid and light in weight, e.g., plastic or cardboard, and which has a front surface, a rear surface, a top edge, a bottom edge and opposite side edges and is formed to have a vertical groove in its rear surface so as to divide the panel 10 into left and right panel sections 12 and 13, the vertical groove effectively providing a weakness line between the two panel sections, this weakness line providing a hinge joint 11. Two upwardly open pouches 14 and 15 are respectively attached to lower portions of the front surfaces of the panel sections 12 and 13, the pouches being sized and shaped so as to receive the toe ends of two matching footwear articles, in this case a pair of slippers 30 and 31. The pouches can be formed of any suitable material, including plastic or cloth. The left and right panel sections 12 and 13 can be manually pivoted around the hinge joint 11 so that the rear surfaces thereof come in contact with one another as shown in FIG. 1, this representing the completely folded condition of the footwear support device. When the footwear support device is in its completely folded condition it (together with the slippers mounted thereon) can be inserted into a packaging container 35 for shipment and display (in this regard, the packaging container may include transparent windows in its sides through which the slippers can be seen). On the other hand, if the left and right panel sections 12 and 13 are pivoted around the hinge joint 11 such that the rear surfaces thereof define an angle of less than 180° therebetween, the device can be positioned on a flat surface 40 to display the slippers mounted therein, as shown in FIG. 2. This constitutes the partially folded condition of the footwear support device.

FIG. 3 shows a first variation of the inventive footwear support device as shown in FIGS. 1 and 2. It can be seen that the left panel section 17 includes a hole 20 in its upper left corner and the right panel section includes a hole 21 in its upper right corner, these holes enabling the device, when in its unfolded condition (the left and right panel sections being coplanar), to be suspended from two spaced apart brackets 50 which extend outwardly from a wall, e.g., for displaying the footwear articles on the wall of a store.

FIG. 4 shows a second variation of the inventive footwear support device as shown in FIGS. 1 and 2. It can be seen that the left panel section 12 includes an attachment nipple 22 and a cut out forming an integral hang tab 23 in its upper left corner and the right panel section 13 similarly includes an attachment nipple 24 and a cut out forming an integral hang tab 25 in its upper right corner. Each integral hang tab is located below an associated attachment nipple and includes a downwardly-extending shank portion 23*a*,25*a* and a head portion 23*b*,25*b* that has a hole 23*c*,25*c* therein. Each integral hang tab can be pushed rearwardly of the panel section from which it is formed and looped up and over the upper edge of the panel section and the hole in the head portion snap fastened over the attachment nipple thereabove. In this way the footwear support device can be hung from an accessory hanger 60 which has downwardly-extending, spaced apart eye hooks 61. The left panel section can also include a hole 26 in its lower left corner and the right panel section can include a similar hole 27 in its lower right corner so that the footwear support device can be used as a support for a similar footwear support device above it, the integral hang tabs of the footwear support device below it fitting through the holes 26 and 27, i.e., as indicated in FIGS. 5–8.

Although a preferred embodiment of the inventive footwear support device and two variations have been shown and described, various modifications therein can be made and still fall within the scope of the appended claims. For example, the vertical groove in the panel 10 could be in front surface thereof instead in the back surface thereof. Indeed, instead of the footwear support device being formed of a single panel which is divided into left and right panels by a groove therein, which forms a a hinge joint therebetween, the panel sections could be formed of separate elements which are connected together along adjacent edges by suitable hinge means.

I claim:

1. A footwear support device which can be in a completely folded condition so as to fit within a packaging container, in a partially folded condition so as to be positionable on a flat surface, or in an unfolded condition, said footwear support device, when in an unfolded condition and vertically oriented, comprising a rigid rectangular left panel section having front and rear surfaces, a rigid rectangular right panel section having front and rear surfaces, hinge means connecting said left panel section to said right panel section, and two upwardly open pouch means respectively attached to the front surfaces of said left and right panel sections, each of said pouch means being capable of containing a toe portion of a footwear article, said left and right panel sections being pivotable about said hinge means to (a) be coplanar when said footwear support device is in an unfolded condition, (b) form an angle of less than 180° between their rear surfaces when said footwear support device is in a partially folded condition, and (c) have their rear surfaces in contact with one another when said footwear support device is in a completely folded condition.

2. A footwear support device according to claim 1, wherein said left panel section includes a hole in an upper left corner thereof and said right panel section includes a hole in an upper right corner thereof, said holes enabling said footwear support device to be suspended from spaced apart wall brackets when in an unfolded condition.

3. A footwear support device according to claim 1, wherein said left panel section, in an upper left corner thereof, includes a first attachment nipple and a cut out below said first nipple forming a first integral hang tab, and wherein said right panel section, in an upper right corner thereof, includes a second attachment nipple and a cut out below said second nipple forming a second integral hang tab, said first and second integral hang tabs being capable of looping from the associated panel section of which they are formed, up and over the upper edge of its associated panel section, and finally down in front of its associated panel section for attachment to the first and second attachment nipples thereabove, respectively.

4. A footwear support device according to claim 3, including an accessory hanger which has two spaced apart eye hooks through which said first and second integral hang tabs can loop.

5. A footwear support device according to claim 3, wherein said left panel section includes a hole in a lower left corner thereof and said right panel section includes a hole in a lower right corner thereof, said holes being located so that integral hang tabs from another similar footwear support device can be looped therethrough.

6. A footwear support device according to claim 3, wherein each of said integral hang tabs includes a shank portion and a head portion having a hole therein, the hole in each head portion snap fitting over the associated attachment nipple.

7. A footwear support device according to claim 1, wherein said left and right panel sections are portions of a single panel, and wherein said hinge means is a weakness line between said left and right panel sections, said weakness line being formed by a vertical groove in said single panel.

* * * * *